US006186225B1

(12) United States Patent
Higgins

(10) Patent No.: US 6,186,225 B1
(45) Date of Patent: Feb. 13, 2001

(54) HEAT EXCHANGER WITH AN INTEGRATED TANK AND HEAD SHEET

(75) Inventor: Terry Higgins, Metamora, MI (US)

(73) Assignee: Lattimore & Tessmer, Inc., Southfiled, MI (US)

( * ) Notice: Under 35 U.S.C. 154(b), the term of this patent shall be extended for 0 days.

(21) Appl. No.: 09/572,774

(22) Filed: May 17, 2000

Related U.S. Application Data

(62) Division of application No. 09/080,475, filed on Sep. 29, 1998, now Pat. No. 6,109,344.

(51) Int. Cl.[7] ..... F28F 9/02
(52) U.S. Cl. ..... 165/173; 29/890.052
(58) Field of Search ..... 165/174, 173, 165/140, 176; 29/890.052, 890.08, 890.043

(56) References Cited

U.S. PATENT DOCUMENTS 4,749,033 * 6/1988 Clausen ..... 165/173
5,398,533 3/1995 Shimanovski et al. .
5,737,952 4/1998 Baumann et al. .
5,829,133 * 11/1998 Joshi et al. ..... 29/890.043
5,898,996 * 11/1998 Buchanan et al. ..... 29/890.052

* cited by examiner

*Primary Examiner*—Ira S. Lazarus
*Assistant Examiner*—Terrell McKinnon
(74) *Attorney, Agent, or Firm*—Harness, Dickey & Pierce, P.L.C.

(57) ABSTRACT

A heat exchanger having a core of a plurality of cooling tubes with a tank at each end of the core tubes. The tanks are formed with a plurality of cooling tube receiving apertures along a side portion of the tanks. These apertures receive the ends of the cooling tubes directly into the tanks and are attached to the tubes by brazing. Since the cooling tubes are received in apertures formed in the tanks themselves, the need for a separate head sheet at the end of the core is eliminated thereby eliminating the need for sealing of a head sheet to a separate tank. The tanks are preferably formed in a hydroforming operation to shape the tanks from a tubular blank.

10 Claims, 2 Drawing Sheets

HEAT EXCHANGER WITH AN INTEGRATED TANK AND HEAD SHEET

This is a division of U.S. patent application Ser. No. 09/080,475, filed May 18, 1998.

BACKGROUND AND SUMMARY OF THE INVENTION

The present invention relates to heat exchangers having a core of cooling tubes with a tank at each end of the core and in particular to a heat exchanger in which the core tubes are directly joined to the tank without an intermediate head sheet.

Typical liquid to air heat exchangers, such as automotive radiators, include a core assembly of a plurality of cooling tubes with fins. The cooling tubes extend between spaced head sheets or header plates. The end of the tubes extend through apertures in the head sheets and are sealed thereto, typically by brazing. A tank formed as a three dimensional stamped metal body or a molded plastic body having an open side, is joined to each of the head sheets and sealed thereto to form a closed tank at each end of the core. Fluid flows from one tank through the cooling tubes to the other tank. A second fluid, typically air, passes between the fins to remove heat from the cooling tubes and thereby cool the fluid in the tubes as it flows from one tank to the other.

The seal between each tank and the head sheet is difficult to properly form and can be the source of leaks during the use of the heat exchanger. Accordingly, it is an object of the invention to provide an improved heat exchanger construction that overcomes the problems associated with the sealing of the core head sheet to the tank.

The present invention overcomes the problems in the prior art by forming the tank and head sheet as an integral, single piece body. A closed tank is formed with apertures along one side for receiving the cooling tubes. The tubes are then inserted directly into the tank. This eliminates the need for a separate head sheet and the need to seal the separate head sheet to the tank. The tubes are sealed to the tank by brazing, in a conventional manner, for constructing a heat exchanger.

The heat exchanger tanks are shaped by a hydroforming process in which an elongated tubular blank is first placed in a die cavity that matches the tank's desired shape. The interior of the tubular blank is sealed and then highly pressurized with a fluid, such as water or oil, so that its outer surface is forced to take the shape of the cavity.

The hydroforming cavity includes inwardly projecting chisel points or punches. After the tube assumes the cavity shape the punches are actuated and pierce the tank.

During hydroforming, outwardly projecting ribs are formed between each of the cooling tube receiving apertures to stiffen the tank. These ribs extend in a circumferential direction relative to the tube longitudinal axis. Cylindrical projections from the tube are also formed during hydroforming. These projections form inlet and outlet necks for the tanks. During hydroforming, the cylindrical projections have closed ends. These ends are later removed, forming the open cylindrically shaped necks.

The open end or ends of the tube blank are closed with an end cap after the tank is hydroformed. The end caps are sealed to the tank by brazing.

An auxiliary oil cooler can be disposed in one of the tanks. The inlet and outlet tubes of the auxiliary cooler extend through one of the tank end caps. The end cap at the opposite end of the tank can be shaped to form a support ledge for supporting the end of the auxiliary cooler.

During hydroforming, outwardly or inwardly extending protrusions can also be formed on the tank to locate the heat exchanger on a rubber mount when attaching the heat exchanger to a supporting structure. The protrusion is typically disposed into a groove in the rubber mount. The rubber mount isolates the heat exchanger from vibration of the support structure, such as an automobile.

Further objects, features and advantages of the invention will become apparent from a consideration of the following description and the appended claims when taken in connection with the accompanying drawings.

DETAILED DESCRIPTION OF THE PREFERRED EMBODIMENT

Figure 1:
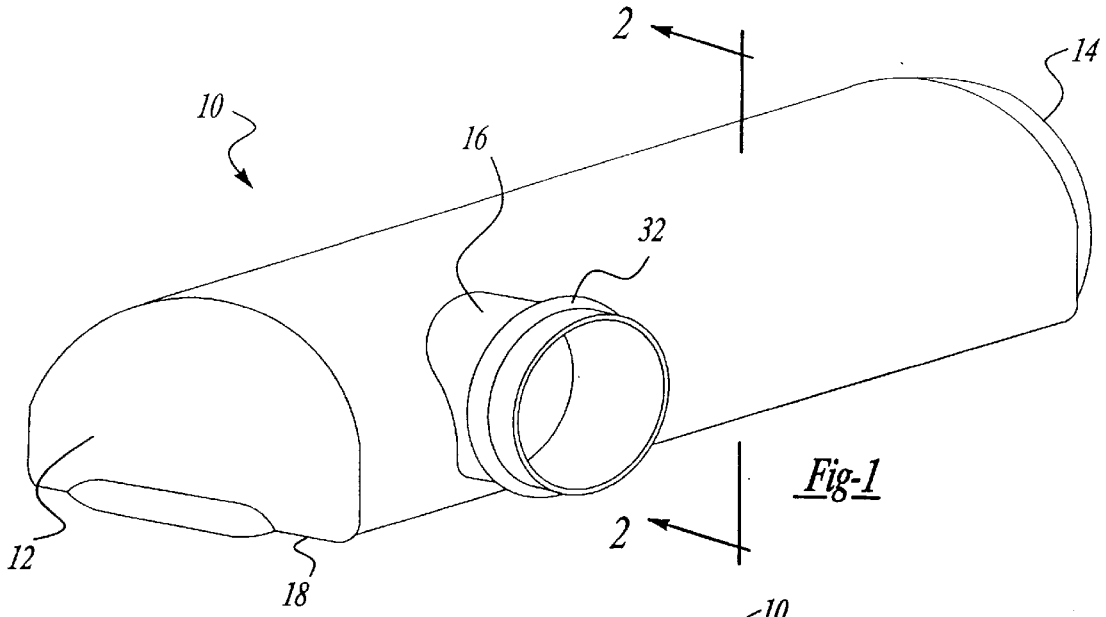
FIG. 1 is a prospective view of a radiator tank constructed according to the present invention.
Figure 2:
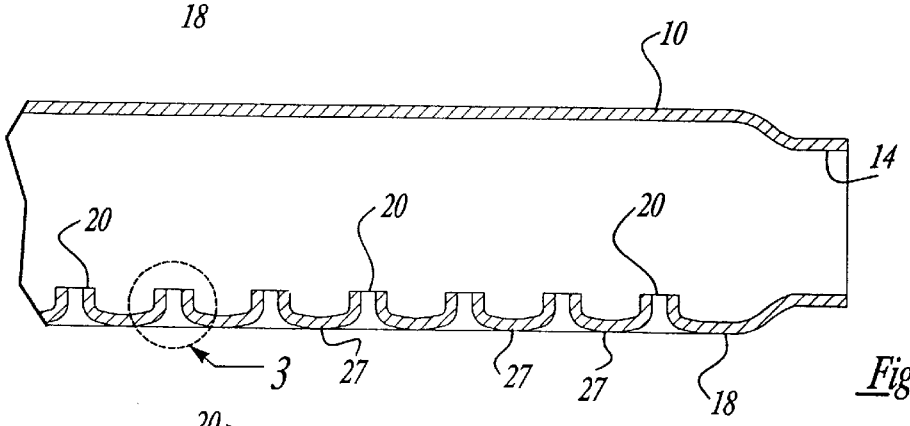
FIG. 2 is a sectional view of the heat exchanger tank as seen from substantially the line 2—2 in FIG. 1.

In reference to FIG. 1, a heat exchanger tank 10 is shown which is made according to the present invention. The tank 10 has a generally tubular body and is shaped by a hydroforming operation. A tubular blank is placed between a pair of dies that close over the tube to create a sealed cavity. The surface of the die cavity matches the desired final shape of the tank 10. The interior of the tubular blank is sealed and highly pressurized with a fluid, such as water or oil, so that its outer surface is forced to take the shape of the cavity. The tank 10 has ends 12 and 14. At least one of the ends is open and possibly both ends are open. The hydroforming liquid is introduced into the tubular blank through an open end. During the hydroforming process, an inlet/outlet 16 is formed which projects or extends from the side of the tank. The tank side portion 18 is generally flat in the preferred embodiment.

Figure 3:
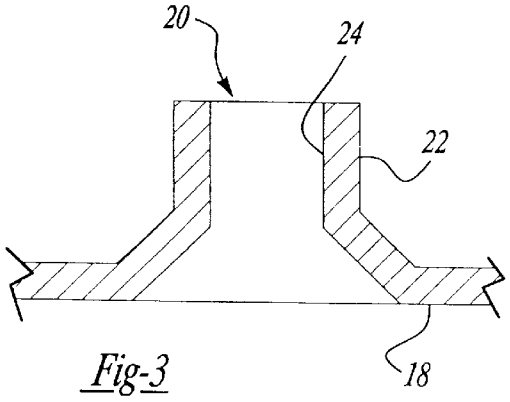
FIG. 3 is an enlarged sectional view of the circled portion of FIG. 2.
Figure 4:
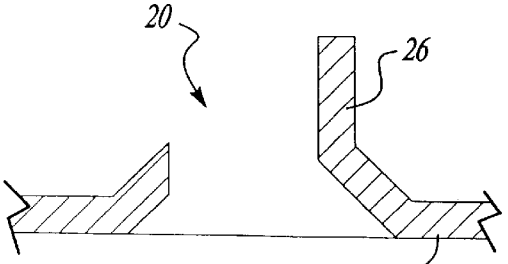
FIG. 4 is an enlarged sectional view of an alternative embodiment of the circled portion in FIG. 2

A plurality of chisel points are mounted into the die cavity tool. After the hydroforming operation, the chisel points pierce the tank forming, a plurality of cooling tube apertures 20 in the tank side portion 18. With reference to FIG. 3, a cooling tube aperture 20 is shown in greater detail. As a result of the chisel point pierce operation, the aperture is surrounded by an upstanding ferrule 22. The upstanding ferrule 22 provides a relatively large surface area 24 for contact with a cooling tube that is subsequently inserted into the hole 20. An alternative embodiment of the ferrule is shown in FIG. 4. There a 3-sided punch is used which forms an upstanding slug 26 to one side of the aperture 20.

Between adjacent tube apertures 20, an outward projecting rib 27 is formed. The ribs extend in a circumferential direction transverse to the tube length to stiffen the tank.

Figure 5:
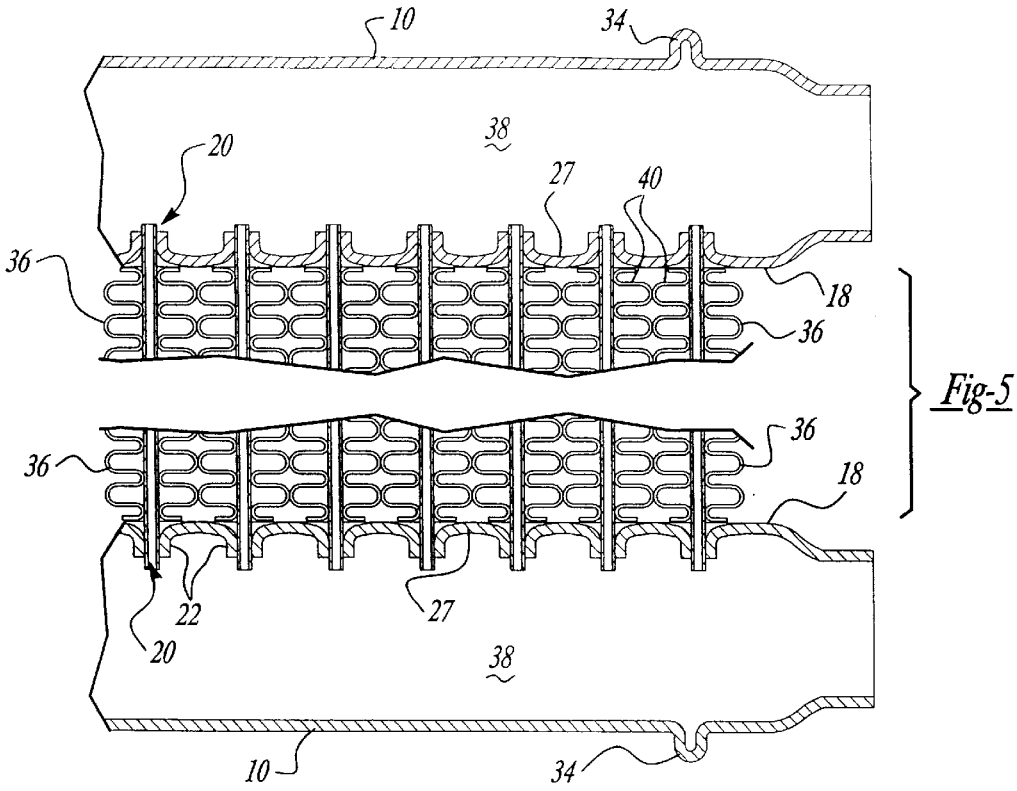
FIG. 5 is a sectional view of a heat exchanger having two tanks and cooling tubes therebetween.
Figure 6:
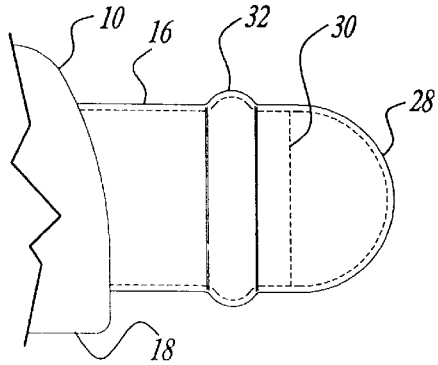
FIG. 6 is a side elevational view of an inlet/outlet to the radiator tank.

With reference to FIG. 6, an inlet/outlet 16 is formed during the hydroforming process. The inlet/outlet neck 16 has a closed end portion 28 which may be formed hemispherically as shown in FIG. 6. The closed end portion 28 is removed by cutting the inlet/outlet along the line 30, thereby creating an open end on the inlet/outlet. A raised rib 32 around the neck assists in retaining a hose on the neck. Identically shaped tanks can be used on both ends of the core. On one tank, the neck 16 will be the heat exchanger inlet. On the other tank, it will be the heat exchanger outlet. Both tanks can be made with the same hydroform die. An assembled heat exchanger is shown in greater detail in FIG. 5. A pair of identical tanks 10 are shown spaced from one another. The tanks are oriented with their two flats side positions 18, with the cooling tube apertures, facing each other. The ends of a plurality of cooling tubes 36 are inserted into the cooling tube apertures 20 of each tank. The tubes 36 are typically surrounded by a plurality of flat or corrugated fins 40 to assist in heat transfer from the tubes. The tubes are subsequently brazed to the tanks 10 in a furnace brazing operation in a conventional manner for manufacturing heat exchangers. This provides a sealed connection between the cooling tubes 36 and the tanks 10. The tubes can be at any cross sectional shape but are preferably flat tubes. The tube apertures 20 are correspondingly slot shaped. The slots are oriented parallel to the ribs 27, in a circumferential direction, relative to the tank.

The tanks can be hydroformed with protrusions 34 to locate the tank on a rubber mount, etc., when mounting the heat exchanger on a support structure, such as an automobile body.

The tanks and tubes can be made of aluminum, brass, steel, stainless steel or any of a variety of metals used in heat exchangers or which could be used in heat exchangers.

Figure 7:
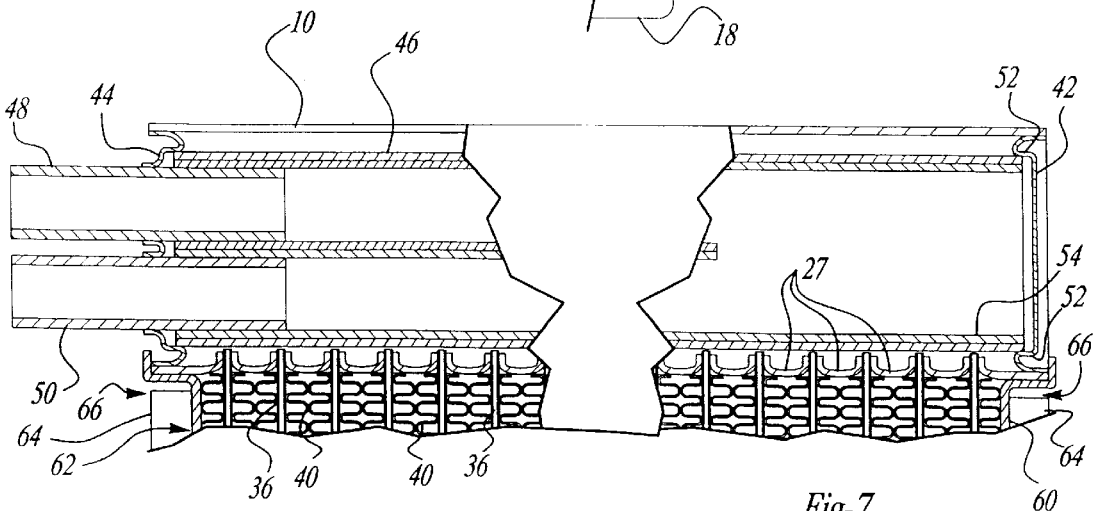
FIG. 7 is sectional view of a tank having an auxiliary oil cooler therein.

With reference to FIG. 7, a tank 10 is shown sealed at the ends by a pair of end caps 42 and 44. The end caps are stamped to shape and are also clad so that they can be brazed to the tank ends. In the embodiment shown in FIG. 7, the tank houses a secondary or auxiliary oil cooler 46 used to cool engine oil or transmission oil in an automotive radiator. The auxiliary cooler has an inlet pipe 48 and an outlet pipe 50 extending through the end cap 44. The end cap 42 is stamped in a shape to form a support ledge 52 to support the distal end 54 of the auxiliary cooler. The end caps are mechanically joined to the tank by toggle locks or other metal crimping operations to hold the end caps in place during assembly and prior to the brazing process.

The heat exchanger may also include a pair of side supports 60 and 62 shown in FIG. 7. These side supports extend between the two tanks 10 and hold the tanks in place relative to one another. These side supports include an outward extending flange 64 to stiffen the side supports. However, at the ends of each side support, there is a small gap 66 in the flange. This forms a stress relief to allow the heat exchanger to expand and contract during thermal cycling.

The heat exchanger of the present invention provides an integrated tank and head sheet. The cooling tube apertures are formed directly into the tanks. This avoids the need for a separate head sheet connected to the cooling tubes which must subsequently be sealed to a tank. In a preferred method of manufacture of the heat exchanger, the tanks are hydroformed to the desired shape and the cooling tube receiving apertures are pierced into the tank after the hydroforming operation. The heat exchanger is subsequently assembled by inserting the cooling tubes directly to the tanks and sealing by brazing, or other joining process.

It is to be understood that the invention is not limited to the exact construction illustrated and described above, but that various changes and modifications may be made without departing from the spirit and scope of the invention as defined in the following claims.

What is claimed is:

1. A method for making a heat exchanger comprising the steps of:

placing an elongated tube having at least one open end into a die cavity and closing the cavity and to form an integral piece projecting outward from the side of the tube;

hydroforming the tube to a desired shaped by filling the tube with a pressurized fluid to deform the tube outward into engagement with the surface of the die cavity;

the die containing a plurality of chisel points or pierce punches to pierce apertures into the tube along one side portion thereof while the tube is in the die cavity thereby forming cooling tube receiving apertures in the tube;

after removing the shaped tube from the cavity, closing the at least one open end with an end cap to form a first tank;

forming a second tank by repeating the above steps;

providing a plurality of cooling tubes sized to fit into the cooling tube receiving apertures and inserting a first end of each cooling tube into a cooling tube receiving aperture in the first tank and inserting a second end of each cooling tube into a cooling tube receiving aperture in the second tank; and sealingly joining the cooling tubes to the first and second tanks whereby fluid can flow from the first tank through the cooling tubes to the second tank.

2. The method of claim 1 wherein during hydroforming of the tank said integral piece projecting outward from the side of the tube is formed with a closed end; and further comprising the step of removing the closed end of the cylindrical projection after the tank has been removed from the die cavity to form an open inlet/outlet neck.

3. The method of claim 1 wherein during hydroforming of the tank an outwardly extending flange is formed from the side of the tank for subsequent seating into a groove in a heat exchanger mount.

4. The method of claim 1 wherein during hydroforming of the tank outwardly projecting ribs are formed between the adjacent cooling tube receiving apertures which extend in a circumferential direction of the tank.

5. The method of claim 1 further comprising the step of closing the open end of the tubes with an end cap and sealingly joining the end caps to the open end of the tubes forming the first and second tanks.

6. The method of claim 5 further comprising the step of deforming the end cap and tubes to hold the end caps in place to the open end of the tubes prior to the step of sealingly joining the end cap to the tubes.

7. The method of claim 1 wherein said cooling tube receiving apertures are formed by punches.

8. The method of claim 1 further comprising the step of disposing an auxiliary oil cooler in one of the tanks.

9. The method of claim 1 wherein said cooling tube receiving apertures are formed by inwardly projecting chisel points.

10. The method of claim 8 further comprising the step of forming a support ledge on the end of the auxiliary cooler.

* * * * *